US011415281B2

(12) United States Patent
Howard et al.

(10) Patent No.: US 11,415,281 B2
(45) Date of Patent: Aug. 16, 2022

(54) FLICKERING MINERAL LIGHT

(71) Applicant: Mary Elle Fashions, Inc., St. Louis, MO (US)

(72) Inventors: Kenneth A. Howard, Creve Coeur, MO (US); Matthew S. Smith, St. Charles, MO (US)

(73) Assignee: Mary Elle Fashions, Inc., Saint Louis, MO (US)

( * ) Notice: Subject to any disclaimer, the term of this patent is extended or adjusted under 35 U.S.C. 154(b) by 0 days.

(21) Appl. No.: 16/553,675

(22) Filed: Aug. 28, 2019

(65) Prior Publication Data

US 2020/0072426 A1 Mar. 5, 2020

Related U.S. Application Data

(60) Provisional application No. 62/723,481, filed on Aug. 28, 2018.

(51) Int. Cl.
*F21S 10/04* (2006.01)
*F21V 23/00* (2015.01)
(Continued)

(52) U.S. Cl.
CPC ..... *F21S 10/043* (2013.01); *F21S 6/002* (2013.01); *F21V 3/06* (2018.02); *F21V 23/003* (2013.01);
(Continued)

(58) Field of Classification Search
CPC ..... F21S 10/023; F21S 10/043; F21S 10/04; F21S 10/026; F21S 10/005; F21S 6/002; F21S 6/001; F21V 1/10
See application file for complete search history.

(56) References Cited

U.S. PATENT DOCUMENTS 3,868,671 A * 2/1975 Maguire ..... A63B 71/06 340/323 R
4,173,038 A * 10/1979 Kiefer ..... F21V 1/10 362/35
(Continued)

FOREIGN PATENT DOCUMENTS

DE 10059844 A1 * 6/2002 ..... F21V 9/08
DE 102009050700 A1 * 5/2011 ..... F21V 19/0055
(Continued)

*Primary Examiner* — Colin J Cattanach
(74) *Attorney, Agent, or Firm* — Stinson LLP

(57) ABSTRACT

A flickering source of illumination is disclosed. A first, second and third group of LEDs and a control circuit are also disclosed. The control circuit is adapted to control a switch to selectively switch on the first group, the second group, and the third group of LEDs. The flickering source of illumination includes a translucent mineral positioned around the groups of LEDs. The translucent mineral is adapted to allow light emitted by the LEDs to pass through the translucent mineral and illuminate an area adjacent to the translucent mineral. The flickering source of illumination may include a first group of LEDs; a second group of LEDs; and a control circuit. The control circuit may be adapted to control a light output of the first and second groups of LEDs so that the first group of LEDs emits a different color of light than the second group of LEDs. The control circuit may be further adapted to selectively vary a color of the light output of the first group of LEDs and of the second group of LEDs. A translucent mineral positioned around the LEDs is also disclosed. The translucent mineral may be adapted to allow light emitted by the LEDs to pass through the translucent mineral and illuminate an area adjacent to the translucent mineral. The translucent mineral may be selected from a group including a salt rock, quartz, marble and natural stone.

17 Claims, 5 Drawing Sheets

(51) Int. Cl.

| | |
|---|---|
| ***F21V 3/06*** | (2018.01) |
| ***F21V 23/04*** | (2006.01) |
| ***F21S 6/00*** | (2006.01) |
| ***F21Y 115/10*** | (2016.01) |
| ***F21Y 113/13*** | (2016.01) |
| ***F21S 10/02*** | (2006.01) |
| ***F21S 10/00*** | (2006.01) |
| ***F21V 1/10*** | (2006.01) |

(52) U.S. Cl.
CPC ..... *F21V 23/0407* (2013.01); *F21V 23/0485* (2013.01); *F21S 6/001* (2013.01); *F21S 10/005* (2013.01); *F21S 10/023* (2013.01); *F21S 10/026* (2013.01); *F21S 10/04* (2013.01); *F21V 1/10* (2013.01); *F21Y 2113/13* (2016.08); *F21Y 2115/10* (2016.08)

(56) References Cited

U.S. PATENT DOCUMENTS 4,510,556 A * 4/1985 Johnson ..... H05B 47/155 362/184
6,584,713 B2 * 7/2003 Huang ..... G09F 19/02 362/811
6,869,208 B2 * 3/2005 Vogel ..... F21V 3/02 362/284
9,997,031 B2 * 6/2018 Dolezalek ..... G08B 5/36
2002/0172040 A1 * 11/2002 Jautz ..... F21S 2/00 362/238
2010/0284188 A1 * 11/2010 Chen ..... F21K 9/232 362/249.02
2013/0314916 A1 * 11/2013 Clore ..... F21V 5/04 362/235
2014/0022789 A1 * 1/2014 Lin ..... F21K 9/232 362/249.02
2014/0146536 A1 * 5/2014 Li ..... F21K 9/232 362/249.02
2015/0198317 A1 * 7/2015 Feller ..... F21V 23/06 362/249.01
2016/0057829 A1 * 2/2016 Li ..... F21S 6/001 315/313
2016/0327227 A1 * 11/2016 Green, Jr. ..... F21V 23/006
2016/0356479 A1 * 12/2016 Wu ..... F21V 29/56
2017/0184296 A1 * 6/2017 Kadijk ..... F21K 9/232
2018/0163937 A1 * 6/2018 Lee ..... H05B 47/155
2018/0367876 A1 * 12/2018 Story, III ..... F21V 33/0056
2019/0080571 A1 * 3/2019 Auer ..... F21S 8/00
2019/0353317 A1 * 11/2019 Chang ..... F21S 9/02
2020/0046868 A1 * 2/2020 Meng ..... A61L 9/032

FOREIGN PATENT DOCUMENTS

DE 202012004210 U1 * 6/2012 ..... F21S 10/04
KR 20090097521 A * 9/2009
KR 101050278 B1 * 7/2011 ..... F21K 9/232
WO WO-2006089450 A2 * 8/2006 ..... H01L 33/58
WO WO-2016184859 A1 * 11/2016 ..... F21V 23/02

* cited by examiner

FLICKERING MINERAL LIGHT

CROSS REFERENCE TO RELATED APPLICATION

This application claims the benefit of U.S. Provisional Patent Application Ser. No. 62/723,481 filed on Aug. 28, 2018, the disclosure of which is incorporated herein by reference in its entirety.

FIELD OF THE INVENTION

The present invention generally relates to flickering mineral lights. More particularly, the invention relates to translucent minerals that are illuminated from within by flickering LEDs to create a very pleasing effect. The mineral can take the form of a single piece of mineral with a cavity for receiving a plurality of flickering LEDs. The mineral can also take the form of a plurality of pieces of mineral surrounding the plurality of flickering LEDs.

BACKGROUND OF THE INVENTION

Salt rocks have been used with incandescent bulbs to provide therapeutic effects. The heat from the incandescent bulb is thought to release therapeutic agents from the salt rock. The incandescent bulb also provides a constant source of illumination.

SUMMARY OF THE INVENTION

The present invention provides a flickering mineral light that has the appearance of a glowing or molten material is some forms, and a flickering bed of hot coals in other forms. Depending on the rate and spacing of the flickering LEDs within the mineral, other aesthetic appearances can also be created.

In accordance with one aspect, there is provided a flickering source of illumination. The flickering source of illumination includes a first group of LEDs, a second group of LEDs, a third group of LEDs and a control circuit. The control circuit is adapted to control a switch to selectively switch on the first group, the second group, and the third group of LEDs. The flickering source of illumination also includes a translucent mineral positioned around the first group, the second group, and the third group of LEDs. The translucent mineral is adapted to allow light emitted by the first, second and third groups of LEDs to pass through the translucent mineral and illuminate an area adjacent to the translucent mineral. The translucent mineral can be salt rock, quartz, marble or natural stone. The first group of LEDs may emit a different color of light than the second group of LEDs. The translucent mineral may include a plurality of pieces of translucent mineral positioned around the first group, the second group, and the third group of LEDs. A container may be adapted to hold the first, second and third groups of LEDs and the plurality of pieces of translucent mineral.

In accordance with another aspect, there is provided a flickering source of illumination. The flickering source of illumination includes a first group of LEDs; a second group of LEDs; and a control circuit. The control circuit is adapted to control a light output of the first and second groups of LEDs so that the first group of LEDs emits a different color of light than the second group of LEDs. The control circuit is further adapted to selectively vary a color of the light output of the first group of LEDs and of the second group of LEDs. A translucent mineral is positioned around the first group and the second group of LEDs and the translucent mineral is adapted to allow light emitted by the first and second groups of LEDs to pass through the translucent mineral and illuminate an area adjacent to the translucent mineral. The translucent mineral may be selected from a group including a salt rock, quartz, marble and natural stone.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
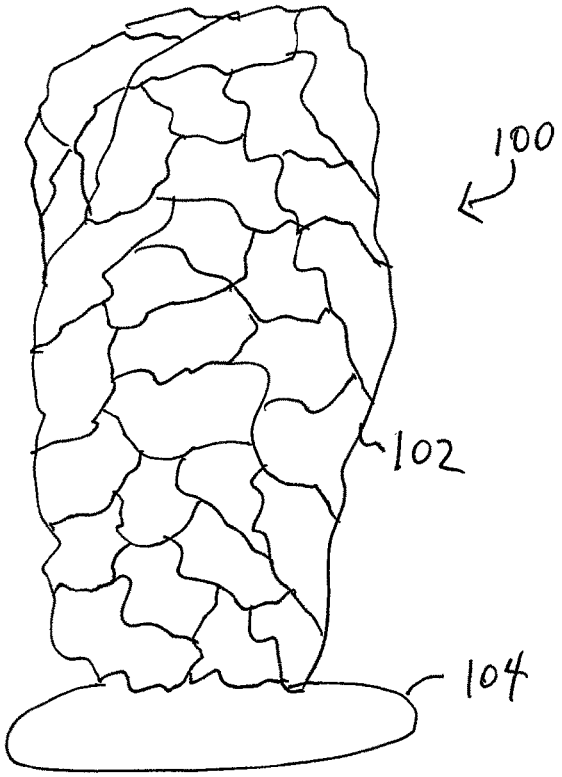
FIG. 1 shows a flickering mineral light.
Figure 2:
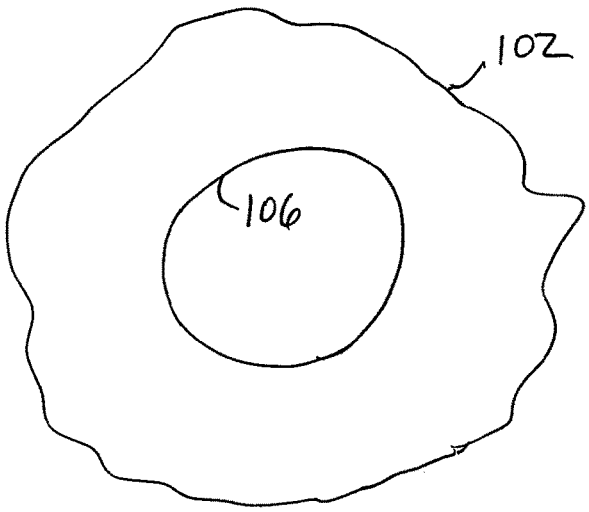
FIG. 2 shows a translucent mineral containing an opening for receiving LED lights.

FIG. 1 shows a flickering mineral light 100. Light 100 includes a translucent mineral 102 mounted to a base 104. As seen in FIG. 2, mineral 102 includes an opening 106 cut into the center of mineral 102. Opening 106 provides room for a control circuit and LED lights, as explained below.

The opening 106 is carefully made so that the remaining thickness in the wall of the mineral 102 between the opening 106 and the outside surface of the mineral 102 is thick enough to be structurally strong but thin enough that the mineral 102 is sufficiently translucent to pass light produced by LED lights there through.

Figure 3:
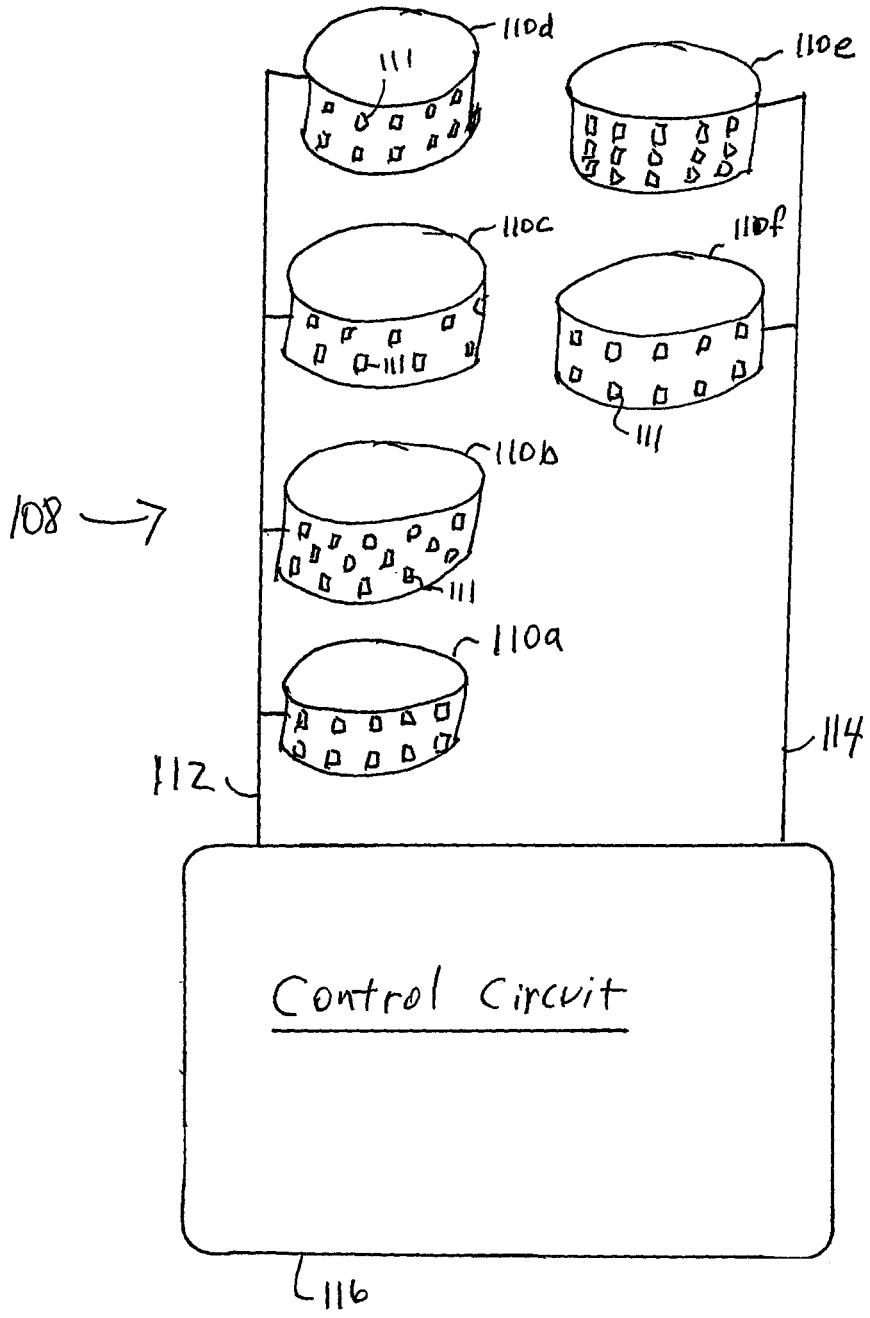
FIG. 3 shows a control circuit and LEDs arranged into groups to be selectively energized by the control circuit.

FIG. 3 shows a plurality of groups of LEDs 108. Each group of LEDs is shown mounted on a separate cylindrical surface 110*a* to 110*f*. As seen, each of the surfaces 110*a* to 110*f* includes a plurality of discrete LEDs 111. A control circuit 116 controls a switch (not shown) to selectively switch on the different groups of LEDs in any preferred pattern and duration via electrical lines 112 and 114. Wiring, not shown, connects each of the LEDs 111 on the various surfaces 110*a* to 110*f*.

Although all of the LEDs 111 on the same surface 110 could be treated as being in the same group of LEDs, sub-groups of LEDs could also be formed on the same surface 110 and energized as their own respective group of LEDs.

In use, the surfaces 110*a* to 110*f* are positioned inside the opening 106 in translucent mineral 102. The LEDs are then selectively turned on by the control circuit 116.

It has been found that the appearance of a flame can be created by switching on the LEDs lower in the mineral 102 for longer periods of time relative to the LED's higher up near the middle of the mineral 102 and to switch on the LEDs near the top of the mineral 102 for only brief bursts to create the appearance of a flame rapidly flickering at its peak. Although cylindrical surfaces 110*a* to 110*f* are shown in FIG. 3, any shape of surface could be used depending on the desired pattern of the LEDs and the illumination effect to be achieved. U.S. Pat. No. 9,689,544 discloses additional structures and LED patterns for further simulating a flame. Indeed, any of the flame simulating LED structures shown in this patent could be used as the light source for any of the flickering mineral lights of the present invention.

Figure 4:
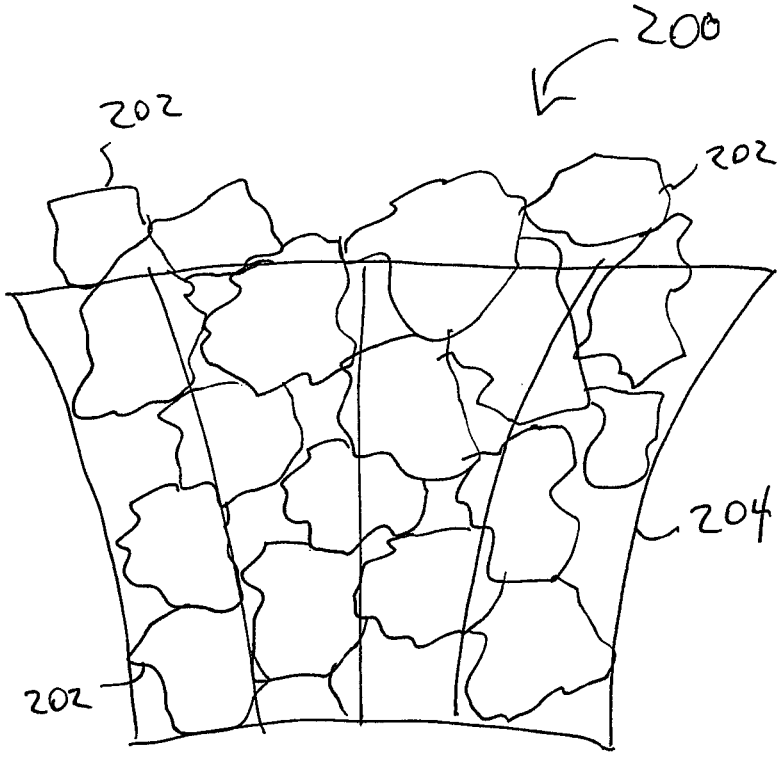
FIG. 4 shows a container holding a plurality of pieces of translucent mineral.

FIG. 4 shows a flickering mineral light 200 made from a plurality of pieces of translucent mineral 202 collected in a container or basket 204. Buried inside of the container 204 of minerals 202 are groups of LEDs and a control circuit (like those shown in FIGS. 3 and 5 but sized for this application) for selectively switching on the LEDs.

Figure 5:
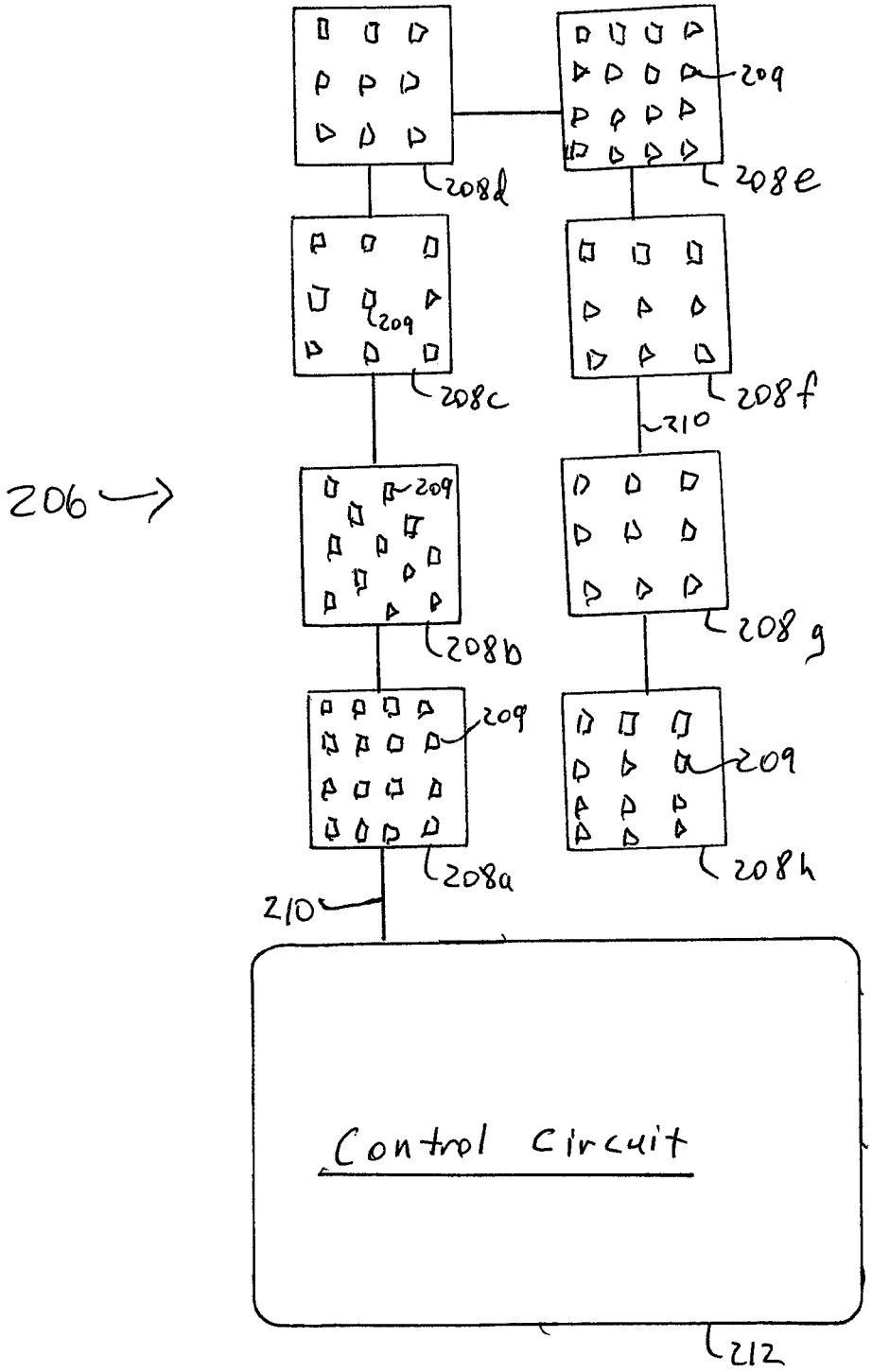
FIG. 5 shows a control circuit and LEDs arranged into groups onto flat circuit boards to be selectively energized by the control circuit.

FIG. 5 shows a plurality of groups of LEDs 206. Each group of LEDs is shown mounted on a separate generally flat circuit board 208*a* to 208*h*. As seen, each of the circuit boards 208*a* to 208*f* includes a plurality of discrete LEDs 209. A control circuit 212 controls a switch (not shown) to selectively switch on the different groups of LEDs in any preferred pattern and duration via electrical line 210 that is connected to each of the circuit boards 208 by conventional means. Wiring, not shown, connects each of the LEDs 209 on the various circuit boards 208*a* to 208*h*.

Although all of the LEDs 209 on the circuit board 208 could be treated as being in the same group of LEDs, sub-groups of LEDs could also be formed on the circuit board 208 and energized as their own respective group of LEDs.

In use, the circuit boards 208*a* to 208*h* are positioned among the pieces of mineral 202 in the container 204. The LEDs are then selectively turned on by the control circuit 212. It has been found that the appearance of a flame can be created by switching on the LEDs lower in the container 204 for longer periods of time relative to the LED's higher up near the middle of the container 204 and to switch on the LEDs near the top of the container 204 for only brief bursts to create the appearance of a flame rapidly flickering at its peak. Although circuit boards 208*a* to 208*h* are shown in FIG. 5, any shape of surface could be used depending on the desired pattern of the LEDs and the illumination effect to be achieved.

Indeed, the cylindrical surfaces 110 and control circuit 116 could be used with the container 204 of mineral pieces 202 in FIG. 4. Likewise, the circuit boards 208 and control circuit 212 could be used with the translucent mineral 102 in FIG. 1

Figure 6:
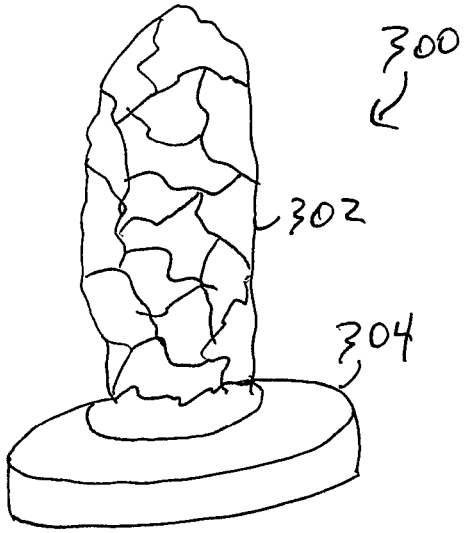
FIG. 6 shows a flickering mineral light in the form of a tap light.

FIG. 6 shows a flickering mineral light 300 in the form of a tap light. As seen, translucent mineral 302 is mounted on top of a conventional tap light 304 such that the tap light 304 mechanically supports the translucent mineral 302. Tap light 304 has been modified to include a control circuit 116 or 212 and corresponding groups of LEDs 108 or 206 as shown in FIGS. 3 and 5. When the mineral 302 is selectively moved or "tapped," the respective control circuit (like those shown in FIGS. 3 and 5 but sized for this application) becomes electrically operable to selectively switch on the groups of LEDs in the mineral 302 and/or to vary their respective color.

Figure 7:
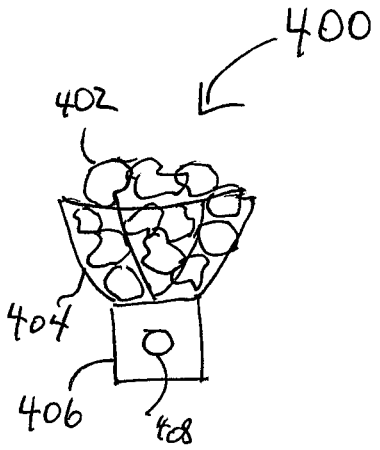
FIG. 7 shows a nightlight base adapted into a flickering mineral light.

FIG. 7 shows a flickering mineral light 400 in the form of a night light. As seen, a plurality of pieces of translucent mineral 402 collected in a container or basket 404. Buried inside of the container 404 of minerals 402 are groups of LEDs. Container 404 is affixed to a conventional base of a night light 406. Night light 406 is modified to include a control circuit (like those shown in FIGS. 3 and 5 but sized for this application) for selectively switching on the LEDs in the container 404 when a photo sensor 408 senses low light ambient conditions.

FIGS. 1 to 7 thus show a flickering source of illumination comprising a first group of LEDs, a second group of LEDs, a third group of LEDs (108 or 206) and a control circuit 116 or 212 adapted to control a switch (not shown) to selectively switch on the first group, the second group, and the third group of LEDs 108 or 206. A translucent mineral 102, 202 and 302 is seen positioned around the first group, the second group, and the third group of LEDs 108 or 206. The translucent mineral 102, 202, 302 and 402 is adapted to allow light emitted by the first, second and third groups of LEDs to pass through the translucent mineral and illuminate an area adjacent to the translucent mineral. The translucent mineral 102, 202, 302 and 402 is preferably selected from a group comprising a salt rock, quartz, marble and natural stone. The translucent mineral 102, 202, 302 and 402 may also be selected from a group comprising a synthetic material adapted to have an appearance corresponding to a salt rock, quartz, marble and natural stone.

As seen, the control circuits 116 and 212 are adapted to control a switch to selectively switch on the first group of LEDs for a longer period of time than the second group of LEDs and to selectively switch on the second group of LEDs for a longer period of time than the third group of LEDs. The control circuits 116 and 212 are further adapted to control the switch (not shown) to selectively switch on and off the first group, the second group, and the third group of LEDs to simulate the appearance of a flame.

In some embodiments, depending on the aesthetic effect to be achieved, the first group of LEDs may emit a different color of light than a second group of LEDs, and a third group of LEDs may emit a different color of light than either the first group or the second group of LEDs.

FIGS. 1 to 7 also show a flickering source of illumination comprising a first group of LEDs, a second group of LEDs, and a control circuit 116 or 212 adapted to control a light output of the first and second groups of LEDs (108 or 206) so that the first group of LEDs emits a different color of light than the second group of LEDs. The control circuit 116 or 212 is further adapted to selectively vary a color of the light output of the first group of LEDs and of the second group of LEDs (108 or 206) and of up to six or more additional groups of LEDs, depending on preference and the desired aesthetic. A translucent mineral 102, 202, 302 or 402 is positioned around the first group and the second group of LEDs (108 or 206). The translucent mineral is adapted to allow light emitted by the first and second groups of LEDs to pass through the translucent mineral and illuminate an area adjacent to the translucent mineral 102, 202, 302 or 402.

In addition to varying the color, the control circuit 116 or 212 is further adapted to selectively switch on four or more additional groups of LEDs. The translucent mineral 102, 202, 302 and 402 is preferably selected from a group comprising a salt rock, quartz, marble and natural stone. The translucent mineral 102, 202, 302 and 402 may also be selected from a group comprising a synthetic material adapted to have an appearance corresponding to a salt rock, quartz, marble and natural stone.

The control circuits 116 and 212 are further adapted to control the switch (not shown) to selectively switch on and off the first group, the second group, and the third group of LEDs to simulate the appearance of a flame and/or to vary the color of the light output of groups of LEDs to simulate the appearance of a flame.

Control circuits 116 and 212 are of conventional construction. They can be programmed to control the color, intensity and lighting patterns of the respective LEDs through means know to those skilled in the art.

Having provided this detailed description, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above systems without departing from the scope of the invention, it is intended that all matter contained in the above description and shown in the accompanying drawings shall be interpreted as illustrative and not in a limiting sense.

What is claimed is:

1. A flickering source of illumination, comprising: a first group of LEDs; a second group of LEDs; a third group of LEDs, a fourth group of LEDs, and a fifth group of LEDs, each group of LEDs being mounted on separate cylindrical surfaces; first electrical lines electrically connecting the separate cylindrical surfaces on which the first, second, and third groups of LEDs are disposed; second electrical lines electrically connecting the separate cylindrical surfaces on which the fourth and fifth group of LEDs are disposed; a control circuit adapted to control a switch to selectively switch on the first group, the second group, the third group, the fourth group, and the fifth group of LEDs; a translucent mineral positioned around the first group, the second group, the third group, the fourth group, and the fifth group of LEDs; wherein the translucent mineral is adapted to allow light emitted by the first, second, third, fourth, and fifth groups of LEDs to pass through the translucent mineral and illuminate an area adjacent to the translucent mineral; and wherein the control circuit is configured to control the switch to selectively switch on the first group of LEDs for a longer period of time than the second group of LEDs and to control the switch to selectively switch on the second group of LEDs for a longer period of time than the third group of LEDs while switching on the third group of LEDs for only brief busts to create the appearance of a flame rapidly flickering at its peak, the second group of LEDs being disposed above the first group of LEDs, and the third group of LEDs being disposed above the second group of LEDs; wherein the second electrical lines electrically connects the fourth and fifth group of LEDs such that a substrate or electrical line does not extend between the fourth and fifth group of LEDs and any of the first, second, or third group of LEDs.

2. The flickering source of illumination of claim 1, wherein the translucent mineral comprises a salt rock, quartz, marble or natural stone, or a synthetic material adapted to have an appearance corresponding to a salt rock, quartz, marble or natural stone.

3. The flickering source of illumination of claim 1, wherein the translucent mineral defines a cavity therein; and wherein the first, second, third, fourth, and fifth groups of LEDs are positioned inside the cavity.

4. The flickering source of illumination of claim 2, wherein the translucent mineral comprises a plurality of pieces of translucent mineral positioned around the first group, the second group, the third group, the fourth group, and the fifth group of LEDs; and/or the flickering source of illumination further comprises a basket adapted to hold the first, second, third, fourth and fifth groups of LEDs and the plurality of pieces of translucent mineral; and/or the flickering source of illumination further comprises a night light base adapted to support the basket.

5. The flickering source of illumination of claim 1, wherein the first group of LEDs emits a different color of light than the second group of LEDs, and/or the third group of LEDs emits a different color of light than the first group and the second group of LEDs.

6. The flickering source of illumination of claim 1, wherein the control circuit is further adapted to control a light output of the first and second groups of LEDs so that the first group of LEDs emits a different color of light than the second group of LEDs.

7. The flickering source of illumination of claim 1, further comprising: a sixth group of LEDs; wherein the control circuit is further adapted to control the switch to selectively switch on the fourth group, the fifth group, and the sixth group of LEDs.

8. The flickering source of illumination of claim 1, further comprising a tap light, and wherein the tap light mechanically supports the translucent mineral and wherein the tap light is adapted to be electrically operable in response to selective movement of the translucent mineral.

9. The flickering source of illumination of claim 1, wherein the translucent mineral comprises a plurality of pieces of translucent mineral collected in a container.

10. The flickering source of illumination of claim 1, wherein each LED in the fourth and fifth groups is laterally spaced from the first, second and third groups of LEDs.

11. A flickering source of illumination comprising: a first group of LEDs; a second group of LEDs, a third group of LEDs, and a fourth group of LEDs, each group of LEDs being mounted on separate cylindrical surfaces; first electrical lines electrically connecting the separate cylindrical surfaces on which the first and second groups of LEDs are disposed; and second electrical lines electrically connecting the separate cylindrical surfaces on which the third and fourth group of LEDs are disposed; a control circuit adapted to control a light output of the first and second groups of LEDs so that the first group of LEDs emits a different color of light than the second group of LEDs; wherein the control circuit is further adapted to selectively vary a color of the light output of the first group of LEDs and of the second group of LEDs; wherein the control circuit is further adapted to control the switch to selectively switch on the third group and the fourth group of LEDs; and a translucent mineral positioned around the first group, the second group, the third group, and the fourth group of LEDs; wherein the translucent mineral is adapted to allow light emitted by the first, second, third, and fourth groups of LEDs to pass through the translucent mineral and illuminate an area adjacent to the translucent mineral; and wherein the control circuit is configured to control a switch to selectively switch on the first group of LEDs for a longer period of time than the second group of LEDs while creating the appearance of a flame rapidly flickering at its peak, the second group of LEDs being disposed above the first group of LEDs, the second electrical lines electrically connecting the third and fourth group of LEDs such that a substrate or electrical line does not extend between the third and fourth group of LEDs and any of the first or second group of LEDs.

12. The flickering source of illumination of claim 11, wherein the control circuit is further adapted to selectively switch on the first group and the second group of LEDs.

13. The flickering source of illumination of claim 11, wherein the translucent mineral comprises a salt rock, quartz, marble or natural stone, or a synthetic material adapted to have an appearance corresponding to a salt rock, quartz, marble or natural stone.

14. The flickering source of illumination of claim 13, wherein the translucent mineral defines a cavity therein; and wherein the first, second, third, and fourth groups of LEDs are positioned inside the cavity.

15. The flickering source of illumination of claim 13, wherein the translucent mineral comprises a plurality of pieces of translucent mineral positioned around the first group, the second group, the third group, and the fourth group of LEDs; and/or the flickering source of illumination further comprises a basket or a container adapted to hold the first, second, third, and fourth groups of LEDs and the plurality of pieces of translucent mineral; and/or the flickering source of illumination further comprises a night light base adapted to support the basket.

16. The flickering source of illumination of claim 11, further comprising:

a fifth group of LEDs;

wherein the control circuit is further adapted to selectively vary a color of the light output of the third group of LEDs, of the fourth group of LEDs and of the fifth group of LEDs.

17. The flickering source of illumination of claim 11, further comprising a tap light, and wherein the tap light mechanically supports the translucent mineral and wherein the tap light is adapted to be electrically operable in response to selective movement of the translucent mineral.

* * * * *